US005107991A

United States Patent [19]

Nichols et al.

[11] Patent Number: 5,107,991

[45] Date of Patent: * Apr. 28, 1992

[54] METHOD AND APPARATUS FOR FRICTION SORTING OF PARTICULATE MATERIALS

[75] Inventors: Carl W. Nichols, Sylacauga, Ala.; Michael J. Lorang; Michael O. Wold, both of Bozeman, Mont.; Jerry W. Rayfield, Sylacauga, Ala.

[73] Assignee: Cyprus Mines Corporation, Englewood, Colo.

[ * ] Notice: The portion of the term of this patent subsequent to Dec. 3, 2008 has been disclaimed.

[21] Appl. No.: 685,690

[22] Filed: Apr. 16, 1991

Related U.S. Application Data

[63] Continuation of Ser. No. 311,175, Mar. 31, 1989, Pat. No. 5,069,346, which is a continuation-in-part of Ser. No. 325,145, Mar. 17, 1989, abandoned, which is a continuation of PCT/US88/02814, Aug. 18, 1988, which is a continuation-in-part of Ser. No. 97,877, Sep. 17, 1987, abandoned.

[51] Int. Cl.[5] ..... B07C 9/00

[52] U.S. Cl. ..... 209/700; 209/691

[58] Field of Search ..... 209/700, 696, 691, 638, 209/642, 695

[56] References Cited

U.S. PATENT DOCUMENTS

| | | | |
|---|---|---|---|
| 897,489 | 9/1908 | Prinz | 209/691 |
| 1,190,926 | 7/1916 | Lotozky | 209/691 |
| 2,068,146 | 1/1937 | Medcalf | 209/691 |
| 2,612,269 | 9/1952 | Vogel | 209/691 X |
| 4,059,189 | 11/1977 | John | 209/691 |
| 4,068,759 | 1/1978 | Abdul-Rahman | 209/691 |
| 4,118,309 | 10/1978 | Myers et al. | 209/691 X |

FOREIGN PATENT DOCUMENTS

| | | | |
|---|---|---|---|
| 210926 | 2/1908 | Fed. Rep. of Germany | 209/691 |
| 899105 | 5/1945 | France | 209/691 |
| 1240476 | 6/1986 | U.S.S.R. | 209/700 |
| 235738 | 6/1925 | United Kingdom | 209/691 |
| 365384 | 2/1931 | United Kingdom | 209/691 |
| 581610 | 10/1946 | United Kingdom | 209/700 |

*Primary Examiner*—Donald T. Hajec

*Attorney, Agent, or Firm*—Banner, Birch, McKie & Beckett

[57] ABSTRACT

Processes by which a mixture of two or more discrete particulate materials, each of said materials having a different sliding coefficient of friction, can be separated using methods which take advantage of velocity differences generated by the application of a force to said mixture to create movement of said mixture over a surface as a function of its sliding coefficient of friction. Various apparatus to effect such processes are also disclosed.

5 Claims, 3 Drawing Sheets

110
112
114
116
118
120
122
123
124
126
130
132
140
142
144
150
158
21
22
24

METHOD AND APPARATUS FOR FRICTION SORTING OF PARTICULATE MATERIALS

This application is a continuation of Ser. No. 331,175, now U.S. Pat. No. 5,069,346, filed Mar. 31, 1989, which is a continuation-in-part of U.S. Pat. application Ser. No. 07/325,145, filed Mar. 17, 1987, now abandoned which is a continuation of PCT application Ser. No. PCT/US88/02814, filed Aug. 18, 1988, which is a continuation-in-part of U.S. Pat. application Ser. No. 07/097,877, filed Sept. 17, 1987, now abandoned.

FIELD OF THE INVENTION

This invention relates to novel methods and apparatus for the separation or beneficiation of a mixture of two or more discrete particulate materials, e.g., a mixture of two or more granular or rocklike mineral materials, each of which materials has a different sliding coefficient of friction. More particularly, this invention relates to sorting of dissimilar materials by methods which take advantage of their difference in sliding coefficient of friction. This invention further relates to improvements in the art of separation of mixtures of unlike material masses, e.g., mineral mixtures, wherein the separability of the constituents of these mixtures results primarily from differences between their respective sliding coefficients of friction rather than from their shape or degree of sphericity.

BACKGROUND OF THE INVENTION

Ores and other minerals when mined usually contain various impurities, i.e, the desired mineral species usually occurs in admixture with other minerals. Thus, the desired mineral or ore usually must be separated from the rest of the material as mined.

Talc, for example, occurs in nature in rock formations in which it is typically associated with other minerals, such as dolomite, chlorite, quartz, pyrite, magnesite, calcite, feldspar, mica, or mixtures thereof. For ease of description, as used in this application, "dolomite" shall be taken to mean dolomite and/or the aforementioned other minerals with which talc shall be admixed or otherwise associated in nature. A run-of-mine ore is generally composed, for the most part, of rocks of predominately one mineral species, e.g., talc rocks are admixed with dolomite rocks, or the like. A very small percentage of conglomerate rocks containing varying mixtures of mineral species, such as talc combined with dolomite in the same rock, may be present as well.

Talc is commonly separated from other minerals, for example, dolomite, by manual sorting or flotation processes. Manual or hand sorting relies upon visual differences between the mineral species such as color variations, degree of granulation, size of the material lumps and the like which are perceptible to the persons doing the sorting. Manual sorting is, obviously labor intensive. It can also give rise to disabling injuries, including carpal tunnel syndrome. Flotation processes are capital intensive, chiefly due to the very expensive equipment necessary to carry them out. Furthermore, vast quantities of water are needed, water that is not available in many mining regions such as ones located in Montana and Australia.

Numerous attempts have been made to develop automated sorting processes for sorting mineral species. Among these are optical sorting, which relies upon optical sensor-perceptible visual differences in light reflection from the surfaces of the ores or minerals to be separated, sink-float processes, which rely upon specific gravity differences in the materials being separated, and electrostatic separation methods based either on electrophoresis or dielectrophoresis, which relies upon the differences in conductivity or shape of the mixture's components. None of these automated sorting processes, however, have been completely successful in that they can be affected by color variations between the particles, shape variations, specific gravity differences and mineral size variations, to name just a few factors.

A number of automated sorting processes based on particle shape have been developed. For example, the separation of coal from its associated rock is shown in U.S. Pat. Nos. 1,030,042, issued Jun. 18, 1912 to Wilmot et al. and 1,190,926, issued Jul. 11, 1916 to Lotozky. Coal suitable for separation by these patented processes is granular in form and generally of a more or less spherical configuration. The associated rock, which includes slate, must on the other hand be present in the form of more or less flat shaped pieces.

In the Wilmot et al. process a mixture of coal and its associated rock is placed in a chute having a rotating disc halfway down its length The coal, being generally spherical in shape, rolls down the chute and comes to rest in a bin at the bottom of the chute. The associated, generally flat rock slides down the chute until it reaches the rotating disc, where it comes to rest and is carried away from the chute by the disc.

In the Lotozky process a chute is not used. Instead, a mixture of coal and rock is fed onto the surface of an inclined rotating disc in a direction opposite to that in which the disc is moving. The coal, which is again generally spherical in shape, continues to roll down the disc in its original direction. The flat rock comes to rest on the disc and is carried away.

These separation processes rely upon the shape of the particles to be separated, in particular the extent to which the particles being separated are, or are not, spherical, thus utilizing both rolling and sliding coefficients of friction in the sorting process rather than differences between the sliding coefficients of friction of the two types of particles being separated. Furthermore, Wilmot et al.'s and Lotozky's rotating discs are used solely to physically carry slate or other flat rocks out of the slate/coal stream, not to impart centrifugal acceleration to separate coal from the other materials present.

Other automated sorting methods and apparatus based solely on particle shape include, for example, those disclosed in U.S. Pat. No. 4,059,189, issued Nov. 22, 1977 to John. The separation of particles with identical composition but different shape is again based on the degree of sphericity of the particles being separated as demonstrated by their differences in rolling and sliding coefficients of friction. Yet another automated apparatus for separating particles based upon their degree of sphericity is shown in U.S. Pat. No. 3,485,360, issued Dec. 23, 1969 to Deinken et al. The Deinken et al. apparatus consists of a rotating disc to which a mixture containing generally spherical and irregularly shaped, generally nonspherical particles of identical composition is fed. The spherical particles roll off the disc, while irregularly shaped particles are forcibly removed from the surface of the disc. Another automated separation process, that disclosed in U.S. Pat. No. 1,744,967, issued Jan. 28, 1930 to Johnson, requires the application of an electrostatic field The Johnson process operates on a frictional difference obtained chiefly by increasing gravitational force by applying an electrostatic force to take advantage of the fact that flat particles create a stronger electrostatic field than spherical particles.

Automated sorting processes have also been developed to separate particles by differences in their adhesive properties; see U.S. Pat. No. 3,508,645, issued Apr. 28, 1970 to Conrad. In the Conrad process sticky particles, such as chicken meat, are made to adhere to a moving surface by static bonding while non-sticky particles, such as associated chicken bones, slide off the moving surface.

Other separation processes have been used to separate material mixtures by gravity concentration using the density differences between the mixture components. These processes may be carried out on ore concentrating tables, a form of a vibratory table.

None of the above-mentioned automated sorting processes separate different mineral species by taking advantage of differences in sliding coefficients of friction exhibited by the mineral species being separated.

It has now been discovered that the constituents of mixtures of discrete particulate materials, e.g., a mixture of two or more granular or rocklike mineral materials of dissimilar chemical constitution but similar physical configuration, can be separated, one from another, by a novel sorting technique that utilizes differences in the sliding coefficients of friction of the materials being separated, thus obviating the need to form such materials into different shapes to effect separation thereof.

It is, therefore, an object of this invention to provide methods and apparatus for separating different materials, including, but not limited to, different minerals having different sliding coefficients of friction by taking advantage of such sliding coefficient of friction differences.

It is also an object of this invention to provide methods and apparatus for the separation of talc from associated minerals and rocks utilizing the differences in the sliding coefficients of friction exhibited by talc and such associated mineral species to produce high-grade talc products and upgraded talc mixtures.

These and other objects, as well as the nature, scope and utilization of the invention will become readily apparent to those skilled in the art from the following description, the drawings and the appended claims.

SUMMARY OF THE INVENTION

This invention is based on the discovery that any mixture of two or more discrete particulate materials, each having significant differences from the others present in the mixture in their sliding coefficients of friction, can be sorted utilizing such frictional differences.

Such particulate mixtures are separated by contacting them with a surface upon which the individual components of the mixture exhibit sliding coefficient of friction differences, and separation is achieved by differences in the movement of the individual components over the surface resulting from the differences in their sliding coefficients of friction. The surface upon which the materials exhibit differences in sliding coefficient of friction may be part of an apparatus in which either accelerative of decelerative forces are applied to the materials to cause differences in sliding movement of the components of the material mixture over the surface. Such apparatus may be of any configuration which effectuates such separations, including but not limited to apparatus containing slides, rotating discs, centrifuges, rotating cylinders, vibrating tables and the like.

DETAILED DESCRIPTION OF THE INVENTION

Figures 1, 1A, 2:
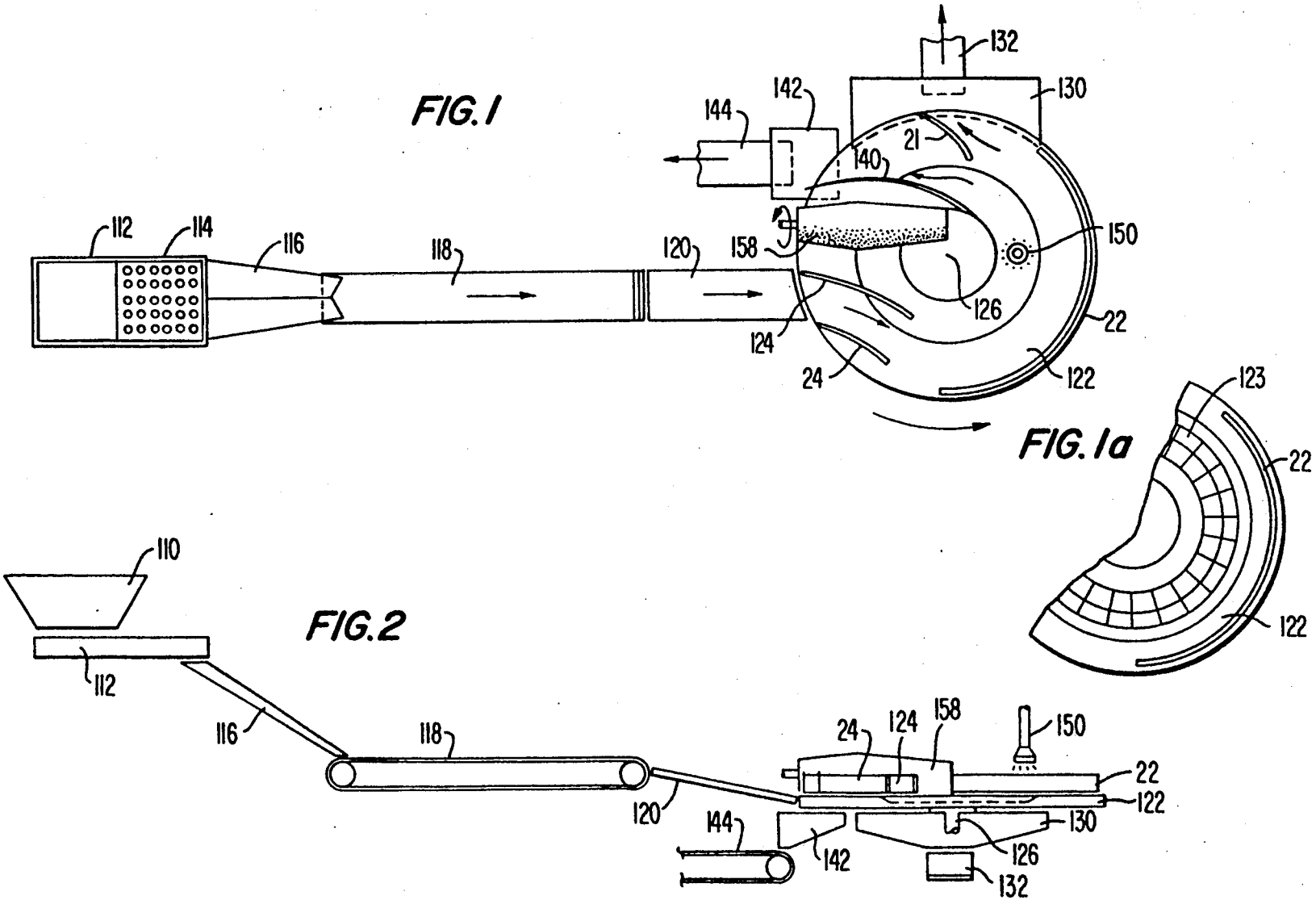
FIG. 1 is a top plan view schematic representation of a rotating disc apparatus embodying this invention which uses a feed conveyor in conjunction with a feed chute and doctor blade to introduce the material mixture being separated to the surface cf the disc on which separation takes place.
FIG. 1*a* is a partial plan view schematic representation of a modified embodiment of rotating disc apparatus embodying the invention.
FIG. 2 is a side view schematic representation of the rotating disc apparatus depicted in FIG. 1.

Among the mixtures of discrete particulate materials which can be separated in accordance with this invention by using sliding coefficient of friction differences between these materials are ores and minerals in the form of granular or rocklike masses from run-of-mine ores, the desired mineral or ore being separated in such cases from rocks made up in whole or part of other materials. Naturally occurring mineral mixtures, e.g., combinations of any of talc, dolomite, chlorite, quartz, pyrite, magnesite, calcite, feldspar, mica, such as talc and dolomite, talc and chlorite, chlorite and dolomite, chlorite and quartz, and the like, are particularly suitable for separation in this fashion. Talc, a hydroxylated magnesium silicate, occurs in nature, as indicated above, in rock formations associated with various mineral species. The most common of these minerals are dolomite, chlorite, quartz, pyrite, magnesite, calcite, feldspar, calcium, and mica. A run-of-mine ore from a talc mine fed to any separation process, including a process in accordance with this invention, typically is in the form of mixtures of rocks ranging in size from fines to larger particles up to about 20 inches in characteristic size. For the most part, each rock in such mixture is made up of predominately one mineral species. A very small percentage of conglomerate rocks may be present which contain mixtures of mineral species. The run-of-mine ore may also contain sand, other rocklike particles, and gangue.

Such mineral mixtures are separated in accordance with this invention by taking advantage of the differences between their individual components' sliding coefficients of friction Coefficient of friction, in broad terms, is a measure of the resistance of an object to movement over a surface expressed in one of three forms: static, dynamic, or rolling coefficient of friction.

Static coefficient of friction, the largest of these three frictional forces, is a measure of the force required to initiate movement of the object over the surface, calculated by taking the tangent of the angle of incline required to initiate movement over the surface. Dynamic coefficient of friction, although smaller than static coefficient of friction, does not differ appreciably from static coefficient of friction at low velocities, and is a measure of the force necessary to maintain the object in a sliding motion over the surface. Dynamic coefficient of friction is calculated by taking the tangent of the angle of incline required to maintain a constant velocity for the object moving over the surface. An object's static or dynamic coefficient of friction is referred to as its sliding coefficient of friction, and is a measure of the object's resistance to sliding.

Coefficient of friction, however expressed, when multiplied by an object's force normal to a surface, gives the force necessary to move the object along the surface at a constant velocity or, in the case of static coefficient of friction, to initiate such movement.

A material's sliding coefficient of friction is unique not only to the material, per se, but also to each surface with which the material comes in contact, and will be affected by such variables as surface hardness, the smoothness of the surface finish, the degree to which the surface is amorphous in character, the material's grain size, and whatever coatings, such as fluids, dust or other contaminants, are found on the surface or associated with the material contacting the surface. Thus, a mixture of discrete particulate materials having similar physical configurations but dissimilar chemical compositions can be separated using the process and apparatus of this invention based on the differences they exhibit in sliding coefficient of friction on any particular surface, unaffected by rock size or rock geometry.

Material mixture separation by sliding coefficient of friction differences in accordance with this invention may be achieved by means of any of velocity difference sorting, slide-retain sorting or differential braking sorting, depending on how the material mixture being separated is made to move across a surface as a function of the sliding coefficients of friction of the mixture's components.

In velocity difference sorting one of the materials being separated will be made to slide at a significantly faster rate over the surface than the other material(s). When the ratio of acceleration of a material mixture parallel to normal on a surface along which the material mixture is moving is greater than the sliding coefficients of friction of the components of the material mixture, the components will move along the surface, each at a velocity inversely proportional to its sliding coefficient of friction. Thus, the lower the sliding coefficient of friction against the surface, the faster the component will move.

In slide-retain sorting one material in the mixture being separated is made to move along the surface while the other(s) remain stationary. The ratio of acceleration parallel to normal on a surface, which is proportional to the sliding coefficients of friction of the materials, is such that the component having the lower sliding coefficient of friction will move along the surface while the component(s) having the higher sliding coefficient of friction will remain stationary on the surface.

Differential braking sorting, a variation of velocity difference sorting, relies on one material slowing down faster than the other material(s) when the components of a mixture being separated are introduced to a surface at the same initial velocity. The rate of deceleration of a material moving parallel to normal on a surface is directly proportional to its sliding coefficient of friction. Thus, materials having higher sliding coefficients of friction slow down more than materials having lower sliding coefficients of friction.

An apparatus used to effectuate material separations in accordance with this invention will comprise means to supply the materials to be separated to a surface upon which the materials to be separated exhibit sufficient differences in their sliding coefficients of friction associated with means to apply a force to cause movement of such materials over the surface so that these frictional differences can be displayed. Such applied forces can be accelerative or decelerative in nature, and may include gravitational and centrifugal forces.

One type of apparatus which can be used in practicing the present invention can be termed generally a rotating disc sorting apparatus, such as depicted in FIGS. 1, 1*a*, 2, shown in the top plan, partial top plan and side views, respectively. When utilizing such an apparatus, a multicomponent particulate mixture, e.g., a mineral mixture such as mixtures of talc and dolomite rocks, is fed by means of a feed system onto a separation surface In the feed system, the multicomponent mixture is fed from a hopper 110 onto a vibrating feeder 112. The vibrating feeder 112 contains a screen 114, which permits fines and other small extraneous particulate materials to be removed from the system as the multicomponent mixture is fed through the vibrating feeder 112. The screen 114 may consist of a sheet metal plate with punch holes of approximately 1.5 inches in diameter. The screened material mixture with the smaller sized particles removed is fed from the vibrating feed 112 to a feed conveyor 118 by means of a slide 116. The slide 116 may have any angle of inclination, and preferably will have a V-shaped trough to accelerate and place the particles or rocks being separated in a single file on a feed conveyor 118. For example, the slide 116 may have a thirty degree V-shaped trough, inclined at an angle of 35 degrees from the horizontal. This provides adequate alignment and spacing of the mixture particles for the disc unit 122 to function properly. The material mixture moves along the feed conveyor 118 to a feed slide 120, which is used to transfer the particulate mixture from the feed conveyor 118 to the surface of the rotating disc 122. For example, the feed slide 120 may be three feet in length and have an angle of inclination of 16 degrees. The feed conveyor 118 is operated at any suitable speed, preferably at a velocity that enables the material mixture as it exits the feed slide 120 onto the disc 122 to have a velocity substantially equal to the tangential velocity of the disc 122 at that point, i.e., the feed point of the rotating disc 122. The velocity of the feed conveyor 118 generally will be greater than the tangential velocity of the disc 122 at the feed point since the accelerative energy of the material mixture tends to dissipate as the material mixture slides down the feed slide 120, hits the doctor blade 124, and changes direction on the surface of the disc 122. As an illustrative example, when the disc 122 has a diameter of six feet, a rotational speed of thirty rpm, and a feed point at the 18 inch radius of the disc 122, then the feed conveyor 118 is operated at a velocity of seven feet per second, which results in the material mixture having a velocity of 4.7 feet per second as it exits the feed slide 120 onto the surface of the disc 122, which is the approximate tangential velocity of the disc 122 at the 18 inch radius feed point. At low feed rates the feed slide 120 may also comprise a separation surface embodied by the present invention and, as such, may apply accelerative or decelerative forces to the material mixture, thus further enhancing the separation of the material mixture. At higher feed rates, the feed slide 120 ceases to function as a separation surface due to the interaction of the material mixture. In such interactions the material component with the lower sliding coefficient of friction shoves the material component(s) having higher coefficients of friction down the feed slide 120 resulting in the material mixture components having essentially the same velocity as they come into contact with the surface of the rotating disc 122. For example, at a feed rate of about forty tons per hour of a mixture of talc and dolomite rocks, the velocities are approximately equal for the talc and dolomite when they contact the disc 122. The surface of the feed slide 120 may be the same or different from that of the surface of the rotating disc 122. A feed doctor blade 124 is used to place, with variable to no spacing, the particles or rocks making up the particulate mixture in a single file on the surface of the disc 122 so as to prevent any portion of this material from either being pushed or trapped by the remainder of the mixture. The feed doctor blade 124 may have any configuration that assists in the placement of the material mixture on the surface of the disc 122 without causing bouncing or rolling the material mixture. Preferably, the feed doctor blade 124 is curved, wherein the degree of curvature may be altered to change the feed point. The feed point will vary depending upon such factors as the composition of the particulate mixture, the size of the particles or rocks being separated and their sliding coefficient of friction differences, and the rotational speed, diameter, surface material and profile of the disc 122. The diameter of the disc 122 may be of any size sufficient to effect separation and is preferably from about two feet to about thirty feet in diameter.

The disc 122, as shown in FIGS. 1 and 2, is rotated in a counterclockwise direction about an axis 126 using any conventional means such as an electric motor (not shown). The rotational speed of the disc 122 will be such that the two or more different species, which make up the particulate mixture, develop velocity differences, based on their respective sliding coefficients of friction, that will depend on which of the three respective embodiments of sliding coefficient of friction can be utilized when practicing this invention—velocity difference sorting, slide retain sorting or differential braking sorting—is being practiced at any particular time. For a given size disc, as the characteristic size of the particles in the mixture decreases, the rotational speed of the disc must be increased to overcome interference with the disc surface's frictional characteristics by fines and the like. And for a given particulate mixture composition and throughput, as the size of the disc 122 is increased, its rotational speed will normally be decreased. The rotational speed of the disc 122 may be any speed; however, due to physical limitations on fabrication and use, the rotation speed of the disc 122 preferably will be from about 14 rpm to about 22 rpm.

The component of the particulate mixture having the lower (or lowest, in the case of three or more components) sliding coefficient of friction on the surface of the disc 122 slides on the surface towards the perimeter of the disc 122 and off the edge of the disc 122, where it is deposited in a bin 130 from which it can be removed by means such as a conveyor 132. The component having a higher sliding coefficient of friction on the disc surface remains stationary, or moves at a slower speed toward the perimeter of the disc 122 and is therefore removed from the disc at a location on the perimeter different from that from which materials having the lower sliding coefficient of friction are removed. Any material remaining on the surface of the disc 122 after a single revolution is removed forcibly from the surface by means, such as a reject doctor blade 140 or any other suitable means, such as a scraper, air jet, vacuum or the like, into a reject bin 142. The contents of the bin 142 can be removed by means of a conveyor 144. Additional bins (not shown) and removal means (also not shown) may be placed at locations on the perimeter of the disc 122 between the bins 130 and 142, the proportion of material components recovered in which will depend upon the added bins' relative location between the bins 130 and 142, with the removed percentage of material with the lower sliding coefficient of friction increasing as the distance of the added bins from the bin 130 decreases. Material recovered from such additional bins may be subjected to a further sorting, either by recycling back to the feed hopper 110 or by feeding to another separation or sorting process.

To alter or adjust the separating characteristics of the apparatus, the surface of the disc 122 can be wetted, by means of a water spray 150, if desired, to impart different frictional surface qualities. A cleaning means 158 may be employed to removal materials, e.g., sand and chips, other than the discrete particulate materials being separated from the surface of the disc 122. The cleaning means 158 may consist of a rotating nylon brush unit or any other suitable cleaning means that effectively removes extraneous material from the surface of the disc 1222 including, but not limited to, a rotary brush unit, a fluid jet, vacuum means, a scraper, or a combination thereof.

The surface profile of the disc 122 can be varied depending upon the amount of gravitational force to be used in the separation process. Any suitable profile may be used including, but not limited too, disc surfaces having a radial cross section that is flat, convex, concave or in the form of a shallow cone. In the case of a flat disc, the minimum acceleration required to slide at least one of the materials being separated will be equal to the selected material's sliding coefficient of friction on the disc surface since the force of such material normal to the plane of the disc surface is equal to this material's weight.

Figure 3:
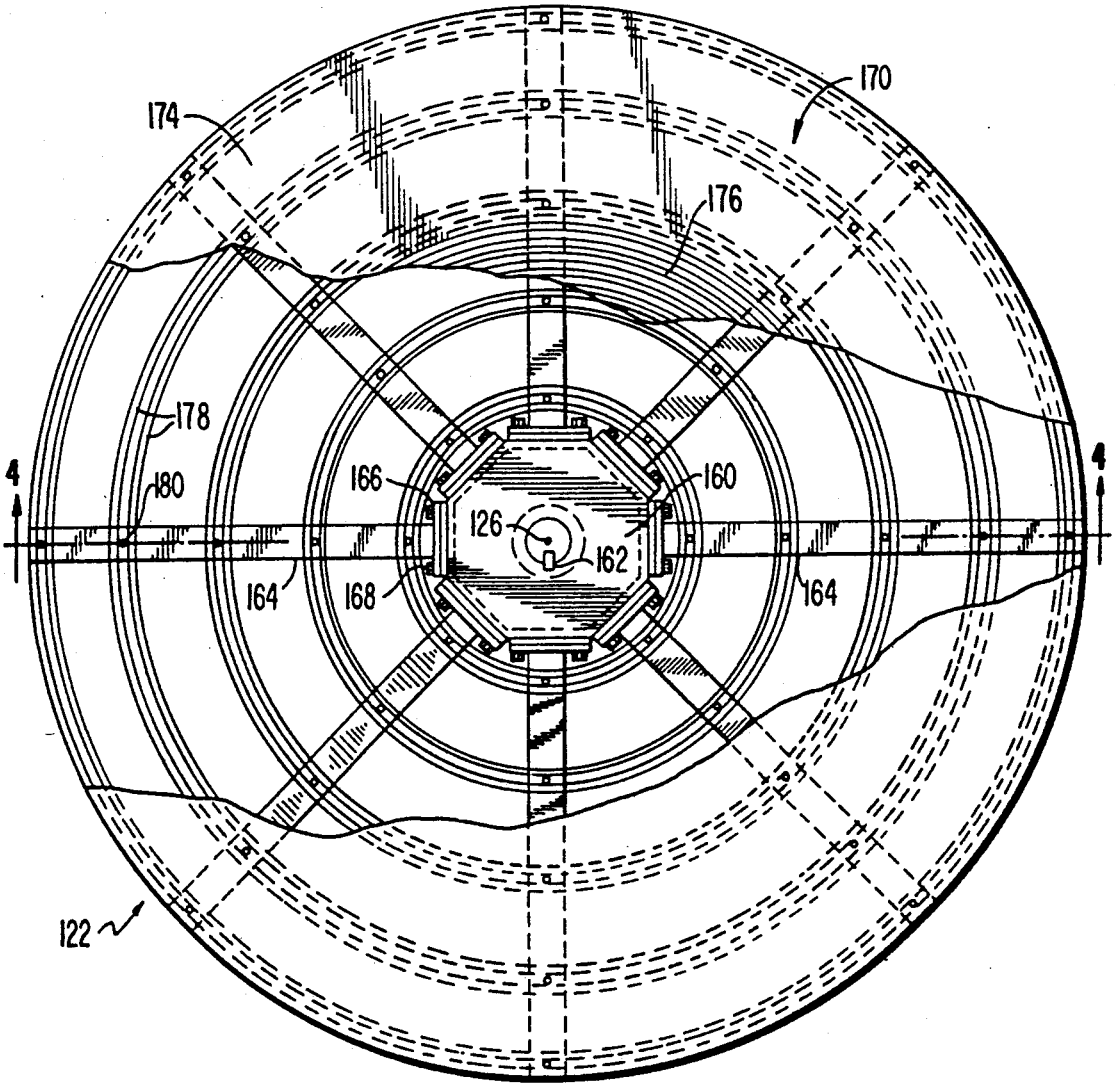
FIG. 3 is an enlarged plan view, partly in section, of the rotating disc apparatus according to the invention.
Figure 4:
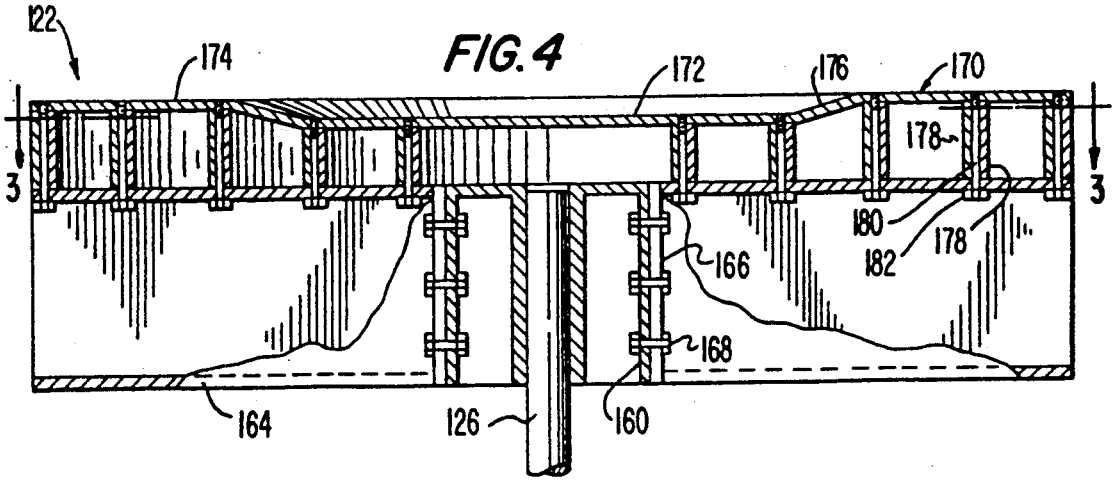
FIG. 4 is a sectional elevational view, partly in section, along line 4—4 of FIG. 3.

Preferably the disc 122 shown in the installation depicted in FIGS. 1 and 2 will have a concave, generally frusto-conical, profile as shown best in FIGS. 3 and 4. A disc having such a profile provides an installation having a higher capacity, and thus permits the separation of larger volumes of materials during a given time period. A concave profile also helps to prevent bouncing and rolling of the materials being separated. In a preferred embodiment of the invention, the surface profile of the disc 122 is configured so that a constant ratio of acceleration of the components of the material mixture to be separated is maintained, particularly over the separating zone of the surface.

The particular details of construction of a disc 122 having this preferred configuration is shown in FIGS. 3 and 4. As shown, the disc 122 is provided with a hub 160, polygonal in cross-section, that is fixed via key 162 to the rotary drive shaft 126. A plurality of support members 164, here shown as being in the form of elongated tubular structural members, are fixedly attached to the hub 160 and extend radially therefrom. Attachment of the members 164 to the hub 160 is effected by means of an end plate 166 butt-welded to the end of each member adjacent the hub, which plate is provided with holes for reception of bolts 168 for securing the plate, and thereby the support member, to the hub.

The radially extending support members 164 support the disc 122, which is formed by sections of steel plate 170. The profile of the plate 170, as shown best in FIG. 4, is configured to define a central horizontal surface 172, an outer annular horizontal surface 174, termed the "shelf", and an intermediate annular transition section 176 that is formed as a frustrum of a cone. The sections of plate 170 are supported in vertically spaced relation from the support members 164 by means of a plurality of concentrically disposed circular bands 178 that are arranged on edge in pairs. Extending between the paired bands 178 are a plurality 178 of bolts 180 having heads 182 at one end disposed interiorly of the support members 164 and having their other, threaded ends received in the plates sections 170 which are drilled and tapped to receive the bolts. The ends of the bolts are thereafter ground flush with the plate surface in order to create an uninterrupted surface for the separation of material according to the invention.

In operation, therefore, screened particulate mixture of talc and dolomite containing particles of a size ranging from about 1.5 inches in diameter to as much as about 30 inches in diameter are deposited onto the surface of the plate 170 shown in FIGS. 3 and 4 at the discharge end of the passage formed by the laterally spaced blades 24 and 124 (FIGS. 1 and 2). Supply of mixture will be deposited primarily onto the central portion 172 of the disc surface; however, the deposition of some of the particles onto the inclined transition portion 176 will not adversely affect separation performance. In practice, in order to prevent rolling or bouncing of the mixture particles, their linear velocity at the point of discharge onto the rotating plate 17 is made to be substantially the same as the tangential velocity of the plate 170 at that joint, so that. initially the relative velocity of the particles to the plate is substantially zero.

Due to the rotational motion of the plate 170, and due to the fact that any bouncing or rolling of the mixture particles is protected against, the particles are caused to migrate radially in proportion to the respective sliding coefficients of friction of the mixture elements. Consequently, talc, having a reduced coefficient of friction on the steel plate, as compared with that of dolomite, will migrate radially across the plate surface at a greater velocity than will the dolomite, so that the talc will traverse the transition section 176 onto the shelf 174 and be discharged ultimately into the bin 130.

Preferably, the angle of inclination of the transition section 176 is calculated to counteract the centrifugal acceleration of the dolomite particles so as to retain them in the central region of the disc 122 for ultimate deflection by the blade 140 into the bin 142. Accordingly, depending upon the rotational velocity of the disc 122 and the diameter of the plate 170, the invention can be practiced with inclination angles in the range of about 4 degrees up to a maximum of about 25 degrees. In the illustrated installation in which the plate 170 has an outer peripheral diameter of fourteen feet and is caused to rotate at about 17.6 rpm, an inclination angle of about 4.8 degrees is determined to be sufficient for adequate separation. Of course, as plate diameter and the velocity of disc rotation increase, the inclination angle of the transition section should be increased commensurately in order to insure accurate separation of the talc from the dolomite without sacrificing yield.

It will be appreciated that, by way of the cooperation of the arcuate baffle plate 22 and the shelf section 174, separated talc will be retained on the shelf by the plate until it is directed by blade 21 into the bin 130. By means of this construction the length of the bin 130 necessary to receive the talc is reduced to one of acceptable proportions.

Figure 5:
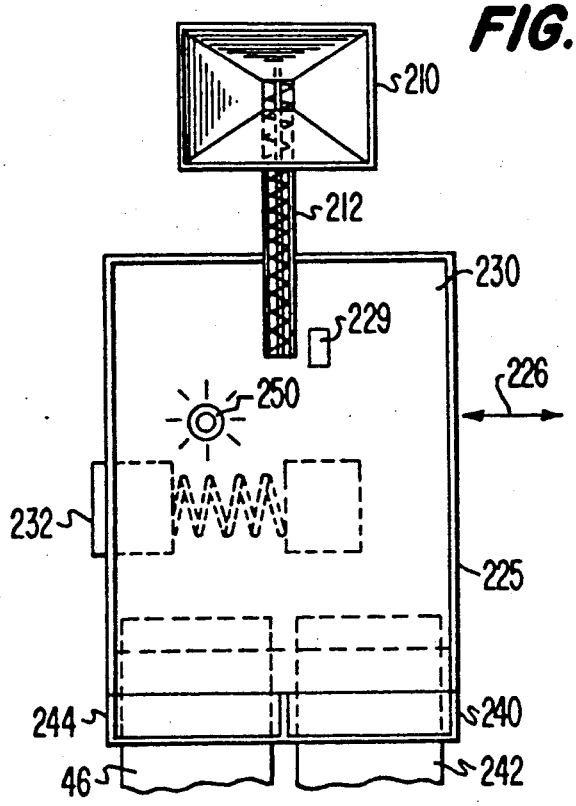
FIG. 5 is a top plan view schematic representation of a vibratory table apparatus embodying this invention wherein the material mixture being separated is introduced by means of a screw conveyor to the surface of the vibratory table on which separation is effected.
Figure 6:
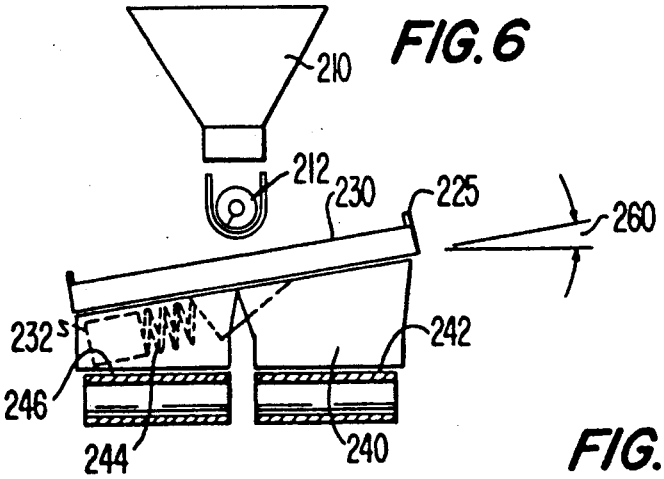
FIG. 6 is a side view schematic representation of the vibratory table apparatus depicted in FIG. 3 showing the tilt of the vibratory table.
Figure 7:
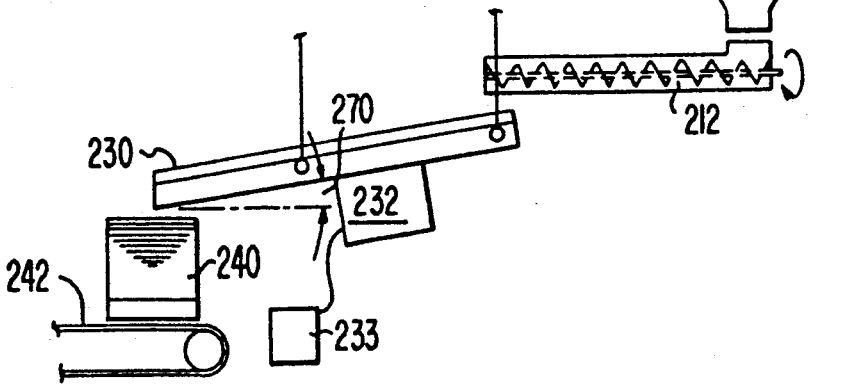
FIG. 7 is a front view schematic representation of the vibratory table apparatus depicted in FIG. 3 showing the slope of the vibratory table.

FIGS. 5, 6 and 7, respectively, depict the top plan, side and front views, respectively, of another type of apparatus in the form of a vibratory table which can be used in practicing the present invention. A multicomponent particulate mixture is fed from a hopper 210 to a screw conveyor 212 which then feeds the material mixture onto the surface 230 of the vibratory table 225. The vibratory table 225 is subjected to vibration in the form of cyclical accelerative force imparted to the vibratory table 225 by a vibrator 232 at an angle to the normal and in a direction indicated by the arrow 226 in FIG. 5. This angle may vary but preferably is about thirty degrees from the horizontal. This cyclical accelerative force results in the particles being conveyed on the surface 230 of the vibratory table 225 by means of a series of actions which may be termed "pitches" and "catches", a "pitch" being the action during which the particles are being thrown forward while the accelerative force is applied, and a "catch" being the particle's landing on the surface as a result of cessation of the accelerative force. The path of the particles is determined by the stroke amplitude and frequency of the vibration imparted to the vibratory table 225. Increases in either the stroke amplitude or thrust force throws the particles forward a greater difference. An increase in the stroke frequency increases the number of such throws during a given time period.

During operation of the vibratory table 225, the multicomponent particulate mixture is subjected to two forces: a cyclical accelerative force in the feed direction and a gravitational force. As a result of the cyclical accelerative force, i.e., the vibration imparted by incubator 232 to the vibratory table 225, the particles are thrown forward. When the particulate mixture contacts the surface 230, the component having the higher sliding coefficient of friction remains substantially stationary on the surface 230. The component having the lower sliding coefficient of friction contacts the surface 230 and slides. The slide direction is dependent upon the gravitational forces exerted on the particles, determined by the slope 260 and the tilt 270 of the surface 230.

During each stroke the particles are thrown forward with an accelerative force of from about three times the force of gravity (3 g's) to about 25 g's. The distance that the particles are thrown forward is dependent upon the sliding coefficients of friction of the particles. The particles having the higher coefficient of friction are thrown further forward than the particles having the lower sliding coefficient(s) of friction. The stroke amplitude is decreased as the thrust force is increased, for example, when the thrust force is increased from about 8 g's to about 25 g's the stroke amplitude is decreased from about ½ inch to about 1/64 inch. The stroke frequency will depend upon the particle size. The degree of slope 260 and the tilt 270 of the vibratory table 225 are adjusted so that the component of the particulate mixture having the higher sliding coefficient of friction does not slide downwardly on the surface 230, while the component with the lower sliding coefficient of friction will slide downwardly, thus enabling separation of the particle mixture when the material traverses the table 225 from the conveyor 212. The tilt 270 of the surface 230 of the vibratory table 225 is depicted in FIG. 7 and varies from about zero degrees to about 45 degrees from the horizontal. The tilt 270 is used to help spread the particle mixture across the surface 230 of the vibratory table 225 to differentiate the velocities of the particles being separated. The slope 260 of the vibratory table 225 is depicted in FIG. 6 and also varies from about zero degrees to about 45 degrees from the horizontal. As the degree of slope 260 of the surface 230 of the vibratory table 225 is increased, the forward motion of the particle mixture is inhibited. This inhibition of forward particle motion enables a shorter surface to be used. The stroke amplitude and frequency are adjusted to match the tilt 270 of the vibratory table 225 and the average particle size of the particles being separated. For example, a mixture of ⅜ inch size talc and dolomite particles can be separated on a wetted aluminum oxide surfaced vibratory table with a slope of ten degrees and a tilt of five degrees with a stroke amplitude of ⅜ inch and frequency of 500 cycles per minute. The particulate mixture component having the higher sliding coefficient of friction is conveyed uphill on the surface 230 by means of a cyclical accelerative force in the direction of feed and is discharged into a bin 240. The contents of the bin 240 may be emptied by any suitable means such as a conveyor 242. The component of the particulate mixture having the lower (or lowest in the case of three or more components) sliding coefficient of friction on the surface of vibratory table 225 slides downwardly on the surface 230 in a direction opposite to the direction of migration of the other component and is discharged into a bin 244, which may be emptied by means of a conveyor 246. This apparatus is particularly well suited for the separation of material having a characteristic size of six inches or less, preferably a characteristic size of one inch or less. To impart different frictional characteristics to the surface 230, a water spray 250 may be used to wet the surface 230. Cleaning means are not needed since the surface 230 is an essentially self-cleaning surface.

The apparatus depicted in FIGS. 1 through 7 may be used to separate a material mixture by any of the three embodiments which can be utilized when practicing this invention—velocity difference sorting, slide-retain sorting and differential braking sorting—or a combination thereof. The specific sorting process used will depend upon, among other factors, the material mixture composition, the relative amounts of each component of the mixture, the characteristic size of the mixture, the range of characteristic sizes present in the mixture, the separation surface, and the initial velocity, if any, imparted to the material mixture before introduction to the separation surface.

Preferred surface materials are ones that accentuate the differences between sliding coefficients of friction of the materials to be separated. However, any surface is acceptable so long as the materials to be separated in fact have a difference in their sliding coefficients of friction on such surface. The smaller the frictional differences are, the more difficult separation becomes, until the point is reached at which even improved equipment design will not prevent incomplete or poor separation.

The higher the sliding coefficient of friction for the surface, the greater the probability that a portion of, or all of, the material will be induced to roll or bounce, a condition to be avoided when practicing this invention. Rolling or bouncing materials will not contact the surface for a sufficient period of time to develop the sliding coefficient of friction differences essential to the sorting process of the present invention.

Among the separation surface materials which can be used in practicing this invention on which materials being separated exhibit significant differences in their sliding coefficients of friction are ceramics, e.g., abrasion resistant tiles and bricks, metals, such as mile or stainless steel, and high density abrasion-resistant plastics such as high molecular weight polyethylene. The separation surface material will preferably resist abrasion by the particulate materials being separated, since abrasion of the surface can adversely affect the separation process. Accordingly, the surface will preferably be of an equal or greater degree of hardness as the hardest of the components of the particulate mixture undergoing separation.

An operative surface for the separation of mixtures of talc and dolomite rocks is an aluminum-oxide ceramic surface composed of a very fine grain 85% alumina product with a Moh hardness of 9.3 or greater, such as Cerasurf alumina brick (Coors Ceramic Company, Golden, Colorado), and especially preferred are surfaces of this type which have been wetted with water.

The separation surface itself is an essentially smooth, unbroken surface free of any substantial dips or protrusions that may affect the movement of the material mixture to be separated across the surface. When more than one surface section is used, either of the same or different materials, the surface sections are preferably adjusted by any conventional means, e.g., sanding, so that the sections are approximately flush and even. For example, when abrasion resistant bricks, e.g., Cerasurf alumina bricks, are used, the bricks are aligned and grout placed therebetween to give a generally smooth surface. Any edges that protrude are sanded, shaved or filed so as to make the surface level or approximately so.

FIG. 1*a* illustrates an alternative embodiment of a rotating disc 122 employing a ceramic surface that is particularly suitable for utility in the arrangement of FIG. 1 in an application subject to conditions of extreme wear and/or damage. The rotating disc 122 is similar in all respects to the disc 122 of the FIG. 1 embodiment, except that processed steel plates form an annulus 123 in the disc in the region most prone to wear and/or damage. It has been found that, by forming the plates of the annulus 123 of mild steel whose exposed sliding surfaces have been stress hardened by sand blasting or shot peening, the resultant surface produces sliding coefficients of friction with talc and with dolomite that are substantially the same as the sliding coefficients of friction of these materials on the Cerasurf alumina brick referred to in connection with the FIG. 1 embodiment.

In practice, most preferable results are obtained when the sliding coefficient of friction of dolomite is about twice that of talc on a given sliding surface. Acceptable, but less preferable, results can be obtained, however, as long as there is an appreciable difference between the sliding coefficient of friction of the materials to be separated on the sliding surface. In the separation of talc from dolomite, most preferable results are obtained with a sliding coefficient of friction for dolomite of about 0.53 and about 0.25 for talc. Acceptable results are obtained with sliding coefficients of friction of dolomite in the range of about 0.45 to 0.55 and of talc in the range of about 0.20 to 0.25. Lower ratios of the respective sliding coefficients can nonetheless be made operable by adjusting the operating conditions of the equipment, e.g., operating the disc at a lower rotational speed and/or with reduced material feed rates.

Wetting of the surface by water or other fluids can accentuate frictional differences. And while, in some cases, wetting may have no discernible effect on the sliding coefficient of friction of one component, it can significantly reduce the sliding coefficient of friction of another component. Furthermore, for some materials the use of a fluid assists in the development of velocity differences for both components, apparently caused by the fluid's lubrication effect.

The components of the particulate mixtures separated in accordance with this invention are preferably in the form of rocks, rather than fines, which can have a broad range of characteristic sizes, and particularly sizes such that the ratio of the smallest to the largest size is about 1 to 6. As the size range is narrowed, separation efficiency and capacity are increased. Preferably, sand and fines associated with the material mixture are removed prior to introduction of the mixture to the separation surface. Such removal means may include screening or washing of the material mixture to be separated.

The above discussion of this invention is directed primarily to preferred embodiments and practices thereof. It will be readily apparent to those skilled in the art that further changes and modifications in the actual implementation of the concepts described herein can easily be made without departing from the spirit and scope of the invention as defined by the following claims.

We claim:

1. Apparatus for separating a mixture of two or more discrete, rocklike particulate materials of disparate composition on the basis of material composition comprising:

a plate-like member having a separation surface thereon formed of a material effective to provide distinct sliding coefficients of friction between the mixture materials to be separated thereon;

means for rotating said plate-like member in a substantially horizontal plane to impart the mixture materials thereon with centrifigual forces tending to move said materials substantially radially across said separation surface at velocities in accordance with the sliding coefficient of friction of the respective mixture materials on said separation surface;

means for supplying said mixture materials to said separation surface at a point spaced from the outer periphery of said member; and said separation surface including a generally concave portion intermediate said mixture material supply means and said member outer periphery, said concave portion being configured to arrest centrifugally-induced radial movement of one of said mixture materials, but not that of the other.

2. Apparatus according to claim 1 in which said concave portion is formed as a frustoconical section having an angle of inclination sufficient to arrest the centrifugally-induced radial movement of dolomite across said plate, but not talc.

3. Apparatus according to claim 2 in which said angle of inclination is within the range of from about 4 to about 25 degrees.

4. Apparatus according to claim 3 in which said angle of inclination is about 4.8 degrees.

5. Apparatus according according to claim 1 in which said separation surface on said rotating disc has a profile comprising radially inner and outer substantially horizontal surfaces with said outer surface defining the outer periphery of said member being elevated with respect to said member inner surface and a frusto-conical transition section being interposed between and connecting said horizontal surfaces.

* * * * *